US008680773B2

(12) United States Patent
Hering et al.

(10) Patent No.: US 8,680,773 B2
(45) Date of Patent: Mar. 25, 2014

(54) HOLIDAY LED LIGHTING SYSTEM AND METHODS OF USE

(75) Inventors: Dean H. Hering, Raleigh, NC (US); Robert J. Dougherty, Herndon, VA (US); John R. Dixon, Herndon, VA (US)

(73) Assignee: NetCentrics Corporation, Raleigh, NC (US)

( * ) Notice: Subject to any disclaimer, the term of this patent is extended or adjusted under 35 U.S.C. 154(b) by 81 days.

(21) Appl. No.: 13/034,190

(22) Filed: Feb. 24, 2011

(65) Prior Publication Data

US 2011/0210677 A1 Sep. 1, 2011

Related U.S. Application Data

(60) Provisional application No. 61/308,673, filed on Feb. 26, 2010.

(51) Int. Cl.
*H05B 37/00* (2006.01)

(52) U.S. Cl.
USPC ..... 315/185 R; 315/187; 315/200 R

(58) Field of Classification Search
USPC ..... 315/185 R, 185 S, 186, 187, 192, 200 R, 315/205, 246, 291, 294, 312
See application file for complete search history.

(56) References Cited

U.S. PATENT DOCUMENTS 6,157,139 A * 12/2000 Gibboney, Jr. ..... 315/185 S
7,140,920 B1 * 11/2006 Lin ..... 439/620.3
7,597,454 B2 * 10/2009 Chang et al. ..... 362/249.01
2005/0122718 A1 6/2005 Kazar et al.
2006/0082223 A1 * 4/2006 Janning ..... 307/36
2006/0198143 A1 * 9/2006 Cheung ..... 362/251
2007/0159819 A1 7/2007 Bayat et al.
2008/0157688 A1 * 7/2008 Gibboney ..... 315/185 S
2008/0231202 A1 * 9/2008 Li ..... 315/185 R
2009/0134810 A1 * 5/2009 Chung et al. ..... 315/187
2009/0284159 A1 * 11/2009 Yang ..... 315/185 S
2011/0241551 A1 * 10/2011 McRae ..... 315/130

OTHER PUBLICATIONS

The International Bureau of WIPO,PCT International Preliminary Report on Patentability and Written Opinion of the International Searching Authority for International Application No. PCT/US2009/36134 dated Jun. 14, 2011.

* cited by examiner

*Primary Examiner* — Tung X Le
(74) *Attorney, Agent, or Firm* — NSIP Law

(57) ABSTRACT

The present disclosure provides a decorative light string system comprising a light string comprising a plurality of lighting bulbs arranged electrically in series, wherein each light bulb comprises at least two LED chips, wherein half of said LED chips are connected in parallel and wherein half of said LED chips are connected in reverse parallel; and an adapter comprising a rectifier, wherein when the plug of the light string is plugged into the outlet adapter in a first orientation, the rectifier allows passage of a half-rectified wave lighting the LEDs connected in parallel, and wherein when the plug of the light string is plugged into the outlet adapter in a second orientation, the rectifier allows passage of a half-rectified wave lighting the LEDs connected in reverse parallel. Also included are methods of using said adapter and said decorative light string system.

14 Claims, 7 Drawing Sheets

HOLIDAY LED LIGHTING SYSTEM AND METHODS OF USE

PRIORITY

This application claims priority to U.S. provisional patent application Ser. No. 61/308,673, filed on Feb. 26, 2010, the contents of which are hereby incorporated by reference in their entirety.

FIELD OF THE INVENTION

The present disclosure relates to decorative LED lights, and more particularly, to multicolored LED lights connected in reverse parallel.

BACKGROUND OF THE INVENTION

Conventional decorative lights are typically fixed in color and celebratory purpose. For example, some conventional light strings comprise a plurality of lights that all have the same color (e.g., all white, all red, etc.). Another conventional light string comprises a plurality of lights that are multicolored (e.g., red, green, blue, yellow, white, etc.). Further, some of these light strings are designed to all be lit at the same time, while others are designed to turn on and off intermittently (e.g., flashing or blinking). Many of these lights are suitably colored for a particular holiday, e.g., Christmas, where the lights may be solid red and green, as well as other holidays where lights are hung as part of the celebratory decoration, including Easter, where pastel colors are popular, the Fourth of July (i.e., Independence Day) and Memorial Day, where the colors red, white and blue are popular, and Halloween, where orange, black and yellow are popular. For these and other celebrations, such as parties, birthdays, anniversaries and the like, an individual must purchase several different light strings having the appropriate color combination. Typically, the individual will then hang the light strings prior to the occasion and then remove them once the occasion is over. The purchase of numerous light strings can become expensive and the constant placing and removing of the different light strings can be time-consuming To address these problems, color-controllable light strings have been designed. However, these products have many limitations. For example, there may be unattractive non-lit bulbs along the light string in at least some selected color schemes or the number of wired lines along the light strand may be relatively large depending on the number of color combinations. Other considerations and/or limitations also include the longevity of the light string, cost of the light string, the limitations of particular/unpopular colors, etc. U.S. patent application Ser. No. 12/398,266 and PCT Patent Application Ser. No. PCT/US09/36134, the contents of both of which are incorporated herein in their entirety, describe color-controllable lights that that may not be suitable in all situations or environments. Accordingly, there remains a need for a color-controllable light string or an adapter that addresses these limitations and considerations.

SUMMARY OF THE INVENTION

The present disclosure addresses these shortcomings by providing a long-lasting, cost-effective electrical adapter and a color-changeable light string system, and methods of use. One aspect of the disclosure provides an adapter comprising a first end comprising an adapter plug, a second end comprising an adapter outlet, and a rectifier placed between one side of the adapter plug and the corresponding side of the adapter outlet.

Another aspect of the disclosure provides a decorative light system comprising at least one light string having a first end comprising a plug, a second end having a receptacle to receive a plug, and a plurality of light bulbs dispersed between the first end and the second end, each light bulb arranged electrically in series, and the light bulbs comprising at least two LED chips, wherein at least a first LED chip is connected in parallel and at least a second LED chip is connected in reverse parallel; and an adapter comprising a first end comprising an adapter plug, a second end comprising an adapter outlet, and a rectifier placed between one side of the adapter plug and the corresponding side of the adapter outlet, wherein the plug of the light string is plugged into the adapter outlet and the adapter plug is connected to a power source; and wherein when the plug of the light string is plugged into the adapter outlet in a first orientation, the first LED chip is forward biased relative to the second LED chip, lighting the LEDs connected in parallel according to the first LED chip and wherein when the plug of the light string is plugged into the adapter outlet in a second orientation, the second LED chip is forward biased relative to the first LED chip, lighting the LEDs connected in parallel according to the second LED chip.

In certain embodiments, the light system comprises a plurality of light strings electrically connected in series.

In other embodiments, the light system further comprises at least one current limiting resistor serially connected to the light string.

In yet another embodiment, the bulb comprises at least a first LED in a first color and at least a second LED in a second color.

In at least some embodiments, the present disclosure provides a method of using the electrical adapter to half-rectify the electrical current passing through a wired system, comprising connecting the adapter to a power means, connecting a plug of a wired system into said adapter outlet in a first orientation or a second orientation, wherein when said plug of said wired system is in said first orientation, the rectifier allows passage of a half-rectified wave that is passed through said wired system for at least one set of parallel wired elements and wherein when said plug of said wired system is in said second orientation, the rectifier allows passage of a half-rectified wave that is passed through said wired system for at least a second set of parallel wired elements.

In at least some embodiments, the present disclosure provides a method of changing the color of light emitted from a bulb on a light string comprising connecting an adapter to a power means, connecting a plug of the light string into the adapter with the plug in a first orientation or a second orientation, wherein if the light string is plugged into the adapter in the first orientation, the first LED chip is forward biased relative to the second LED chip, lighting the LEDs connected in parallel according to the first LED chip and wherein if the light string is plugged into the adapter in a second orientation, the second LED chip is forward biased relative to the first LED chip, lighting the LEDs connected in parallel according to the second LED chip.

These and other novel features and advantages of the disclosure will be fully understood from the following detailed description and the accompanying drawings.

FIGURES AND DRAWINGS

Figure 4A:
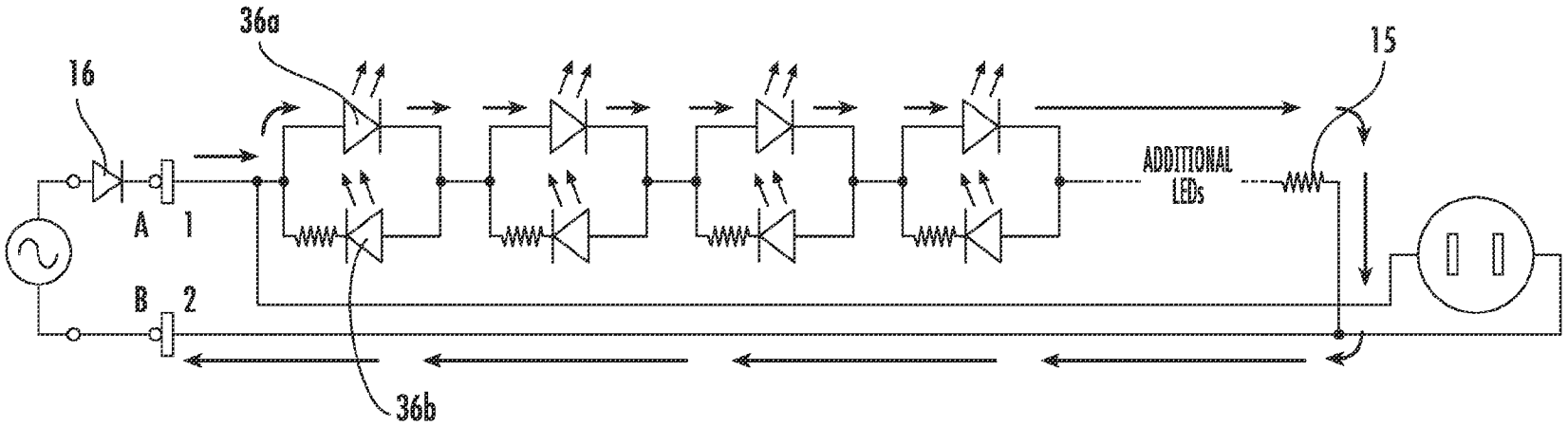
Figure 4B:
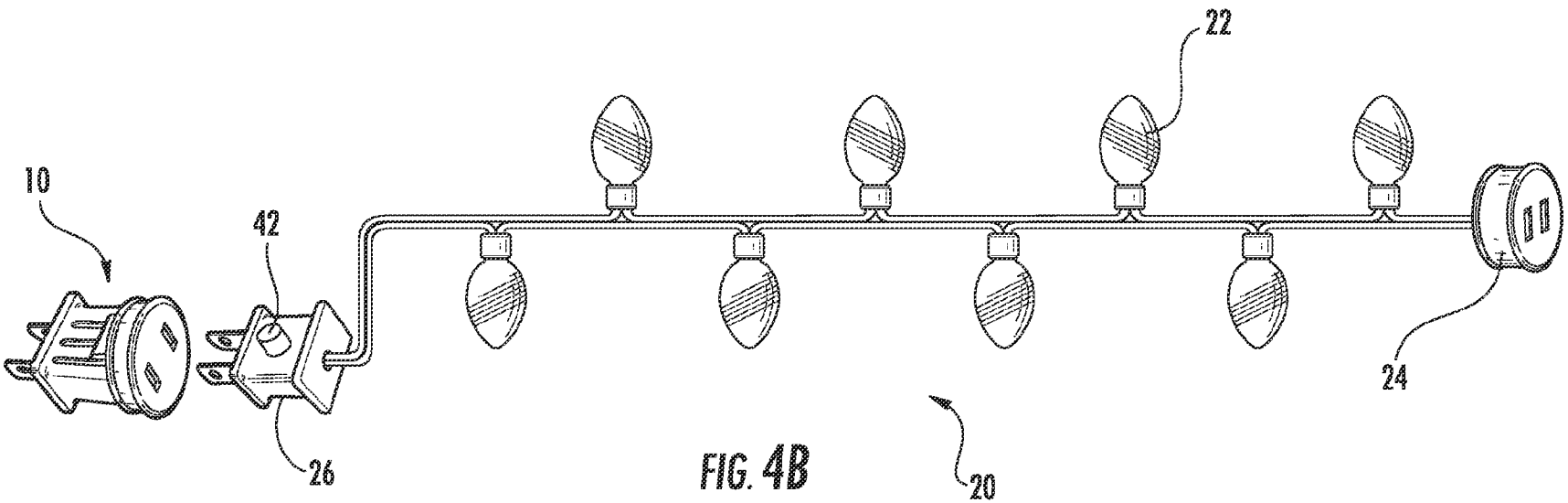
Figure 4C:
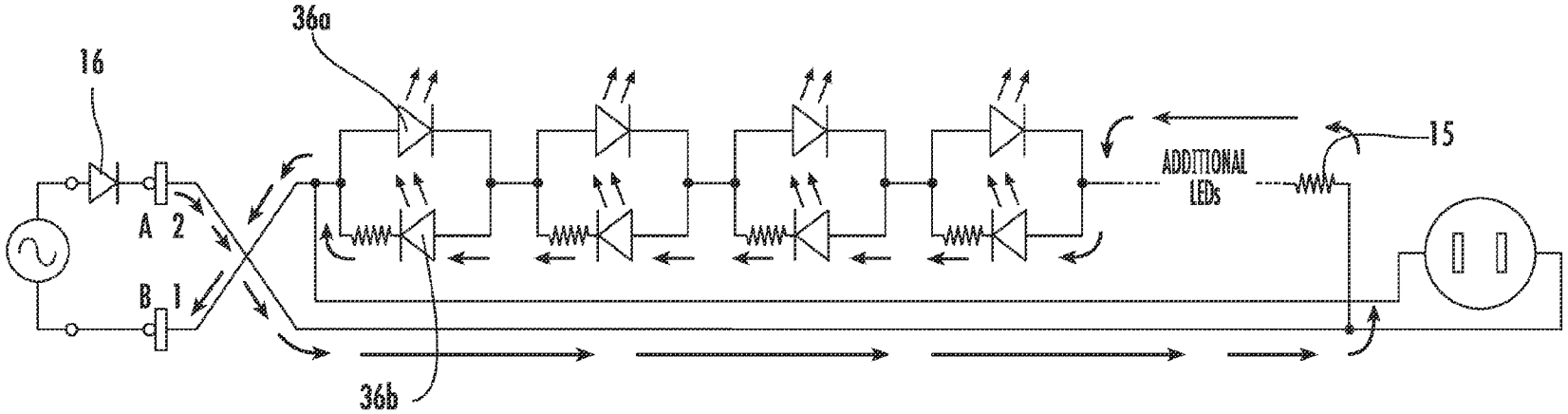
Figure 4D:
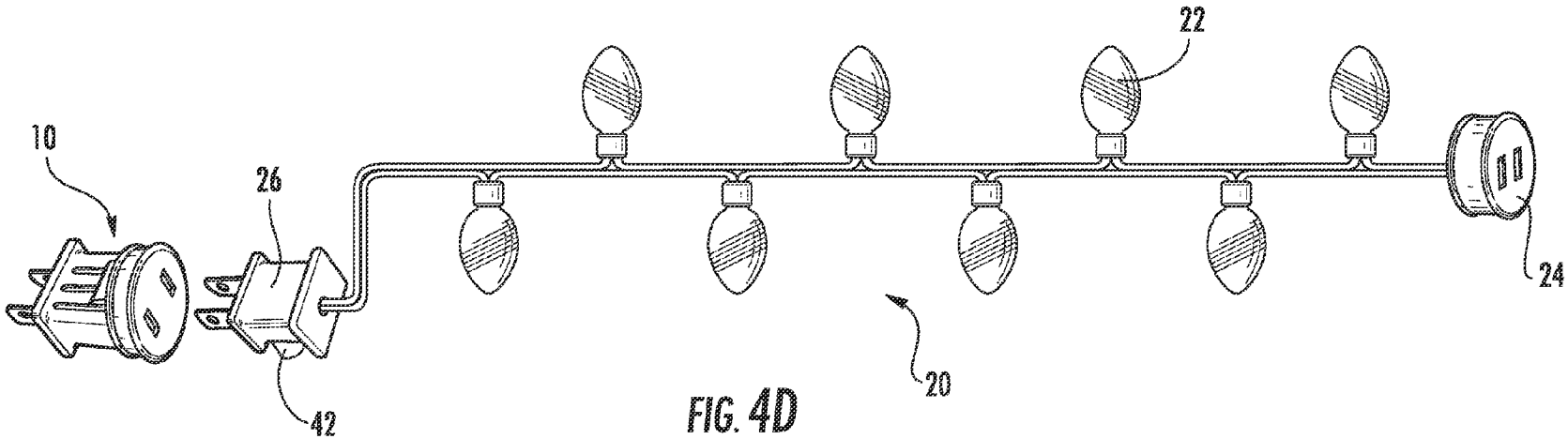

FIG. 4A is a schematic view depicting a light string system according to an embodiment of the present disclosure wherein the light string plug is in a first position, connecting the rectifier in forward bias direction relative to the first color allowing the half-period of the sine AC waveform to light the LEDs in parallel in a first color. FIG. 4B is a depiction of the light string system represented in the schematic of FIG. 4A. FIG. 4C is a schematic view depicting a light string system according to an embodiment of the present disclosure where the light string plug is in a second position connecting the rectifier in forward bias relative to the second color allowing the half-period of the sine AC waveform to the light the LEDs in the parallel reverse direction in a second color. FIG. 4D is a depiction of the light string system represented in the schematic of FIG. 4C.

DETAILED DESCRIPTION

Unless otherwise defined, all technical terms used herein have the same meaning as commonly understood by one of ordinary skill in the art to which this disclosure belongs.

The articles "a" and "an" are used herein to refer to one or to more than one (i.e. at least one) of the grammatical object of the article. By way of example, "an element" means at least one element and can include more than one element.

The present disclosure provides an adapter comprising a first end comprising an adapter plug, a second end comprising an adapter outlet, and a rectifier placed between one side of the adapter plug and the corresponding side of the adapter outlet. The adapter rectifies an incoming current so that the full sine wave becomes a half-rectified wave before passing through a wired system in which there are elements connected in parallel. Thus, the adapter allows a user to select a subset of the wired components in a wired system to electrify.

Embodiments of the adapter described herein can half-rectify the electrical current passing through a wired system. This can be accomplished by connecting the adapter to a power means and connecting a plug of a wired system into said adapter outlet in a first orientation or a second orientation, wherein when the plug of the wired system is in the first orientation, the rectifier allows passage of a half-rectified wave that is passed through the wired system that is forward biased for at least a first set of elements of the wired system. Optionally, the plug of the wired system can be connected to the adapter outlet in a second orientation, wherein when the plug of the wired system is in the second orientation, the rectifier allows passage of a half-rectified wave through the wired system that is forward biased for at least a second set of elements of the wired system.

Figure 1A:
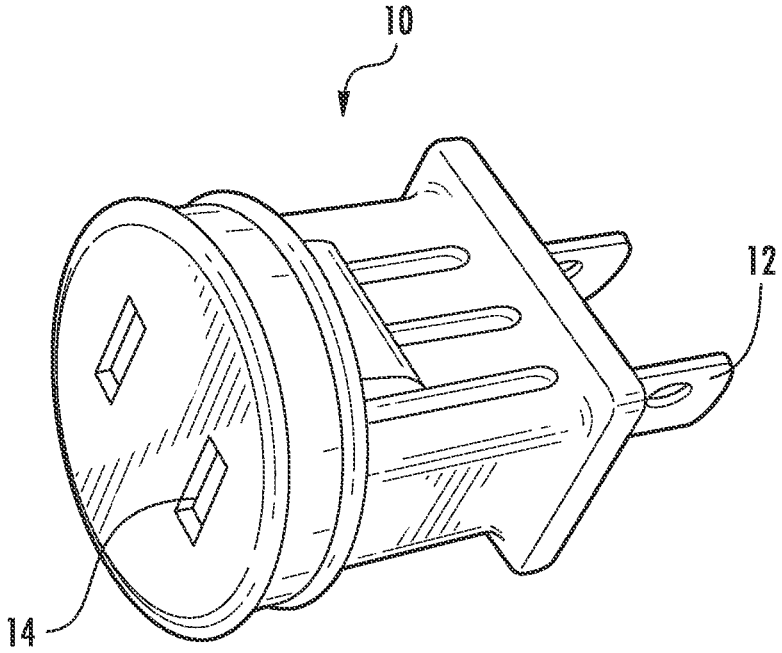
FIGS. 1A and 1B are depictions of an adapter and a light string system according to at least one embodiment of the present disclosure.
Figure 1B:
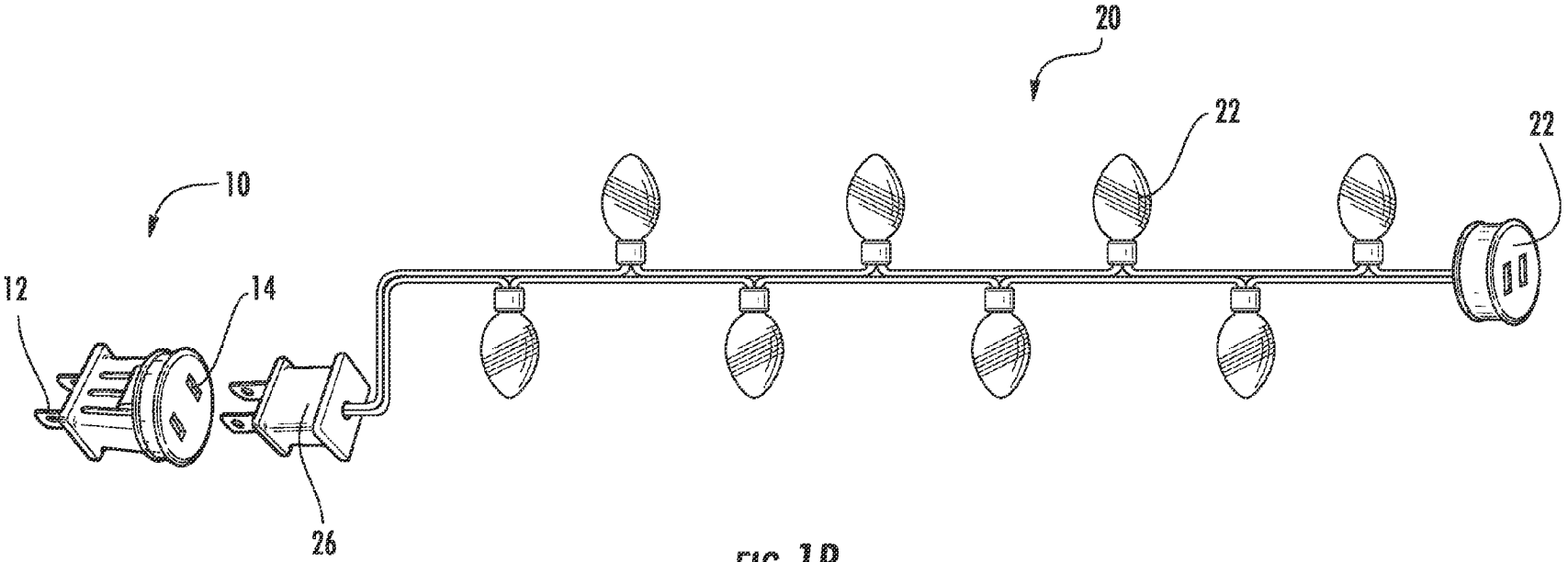

The adapter 10 of the present invention comprises a first end comprising an adapter plug with plug blades 12, a second end comprising an adapter outlet with outlet holes 14, and a rectifier placed between one side of the adapter plug and the corresponding side of the adapter outlet. An example of an embodiment of the adapter is depicted in FIG. 1A, with two plug blades 12 and two outlet holes 14, while FIG. 1B shows a light string system according to at least one embodiment of the invention. The light string system 20 comprises light bulbs 22, a light string outlet 24, a light string plug 26, and an adapter 10. In at least some embodiments of the invention, the light string plug 26 is connected to, or plugged into, the adapter outlet holes 14. The adapter plug blades 12 are connected to, or plugged into, a power source.

The light string system of the present disclosure may comprise many variations, all of which are within the scope of the present disclosure. The total operational voltage of the light string of the present disclosure that is connected in series is equal to AC voltage in commercial power since each unit is connected in series, and thus does not require the need for a step-down transformer. For example, the average power supply to a household is 120V and follows a typical sinusoidal, or sine, waveform. A string of lights having approximately 40 bulbs can in turn be connected in series if the operational voltage of the LED is 3V. In accordance with the present disclosure, half of the LEDs (e.g, one LED per pair of LEDs in a single bulb) are connected in parallel, and therefore the half-period of sine waveform in a first direction (e.g., positive) will cause the lighting of all LEDs that are connected in the forward (parallel) direction. Similarly, all of the LEDs connected in the reverse (reverse parallel) direction thereof will light during the half-period of sine waveform in a second direction (e.g., negative relative to the first direction).

The phrases "light string" and "string of lights" are used interchangeably herein. The lights on the light strings of the present invention can be of any form or type and still fall within the scope of the invention. For example, types of lights on the strings of lights of the present invention include, but are not limited to, C3 lights, C6 lights, C7 lights, C9 lights, miniature lights, globe lights, net-style lights, icicle or drop lights, ribbon lights, and tube lights.

Figure 2:
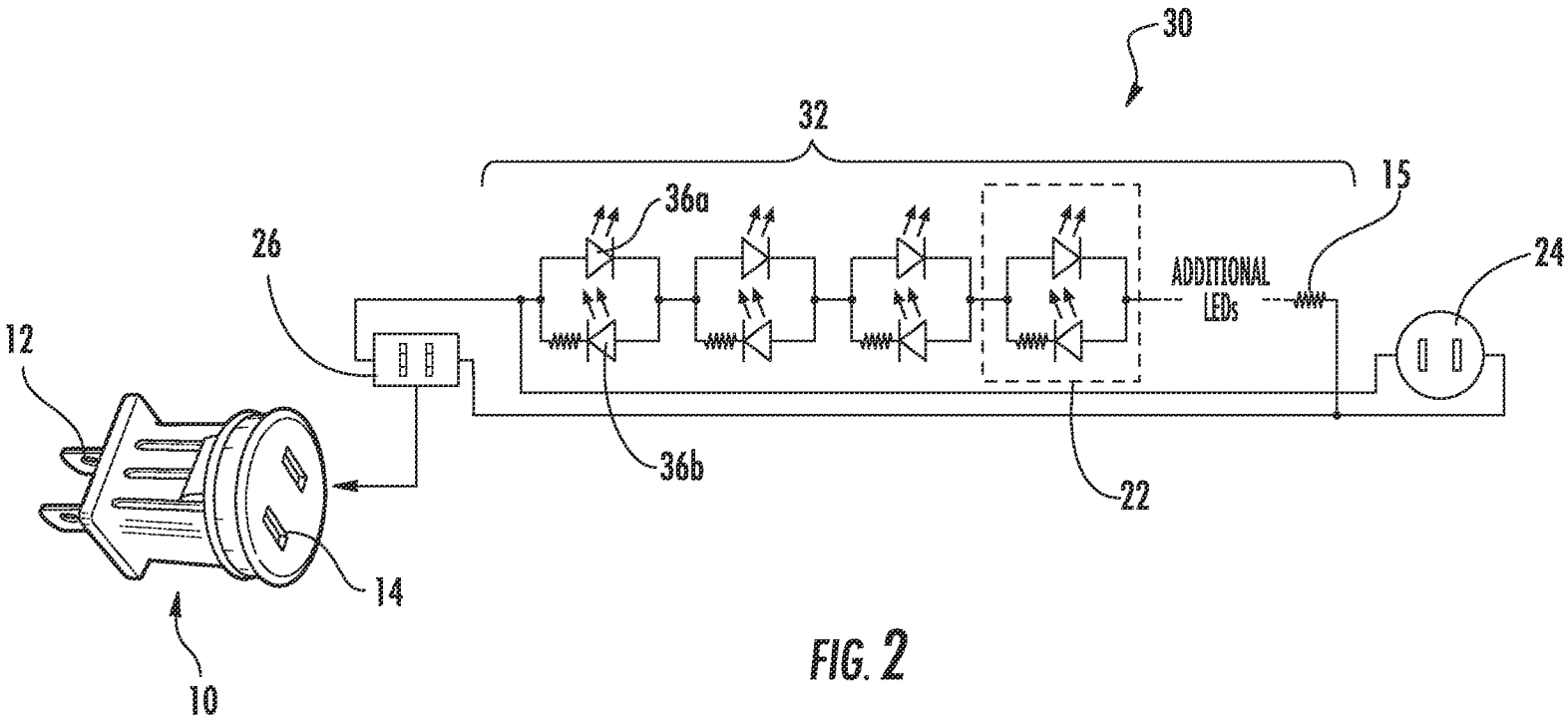
FIG. 2 is a schematic depiction of a light string system according to at least one embodiment of the present disclosure.

FIG. 2 is a schematic depiction of a light string system according to one embodiment of the present invention. FIG. 2 shows a light string system 30 comprising a light string 32 comprising a plurality of light bulbs 22 arranged electrically in series, wherein the light bulbs 34 comprise at least two LED chips 36*a* and 36*b*, wherein at least one LED chip is connected in parallel 36*a* and at least one LED chip is connected in reverse parallel 36*b*, and an adapter 10 comprising a first end comprising an adapter plug 12, a second end comprising an adapter outlet 14, and a rectifier placed between one side of the adapter plug 12 and the corresponding side of the adapter outlet 14, wherein the plug of the light string 26 is plugged into the adapter outlet 14 and the adapter plug 12 is plugged into a power source.

The adapter may be either polarized or non-polarized. In a non-polarized adapter, the adapter plug blades are identical in size to each other, and the adapter outlet holes are identical in size to each other. In a polarized adapter, one of the adapter plug blades is larger than the other adapter plug blade, and one of the adapter outlet holes is larger than the other adapter outlet hole. Thus, a polarized plug can be plugged into a polarized outlet in only one orientation, which is the orientation in which the larger plug blade fits into the larger outlet hole and the smaller plug blade fits into the smaller outlet hole. Non-polarized light string plugs function with either a polarized adapter or a non-polarized adapter. Thus, in some embodiments, a non-polarized light string can be plugged into a polarized adapter in a first orientation or a second orientation. In some embodiments, a non-polarized light string can be plugged into a non-polarized adapter in a first orientation or a second orientation.

Figure 3A:
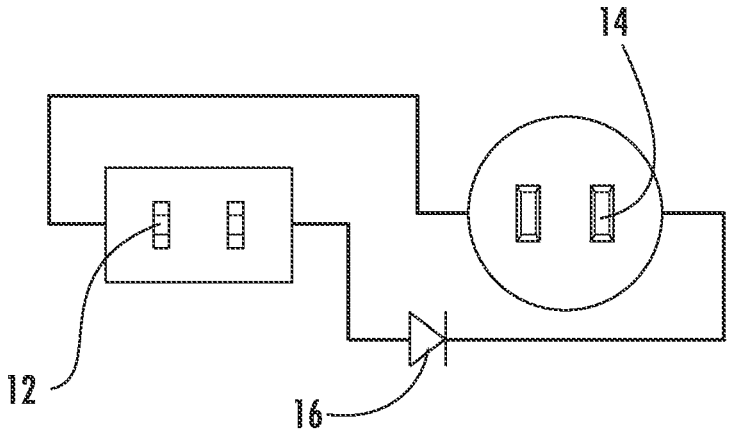
FIGS. 3A and 3C are schematic depictions of an adapter according to some embodiments of the present disclosure.

FIG. 3A is a schematic representation of an adapter according to at least some embodiments of the present invention. The adapter of the present invention, in at least some embodiments, will utilize as a power source a typical AC voltage waveform in a standard household outlet of 60 Hz/120V. In some embodiments, the adapter will utilize as a power source an AC voltage waveform in a standard household outlet of, for example, 50 Hz/220V, 50 Hz/230V, or 60 Hz/110V. One of ordinary skill in the art understands that it is within the scope of the present invention to make the adapter so that it is functional with other power sources, and that the voltages and frequencies with which the adapter can function can vary but will still fall within the scope of the presently claimed invention.

FIG. 3A shows an adapter 10 comprising an adapter plug 12 electrically connected to an adapter outlet 14. The adapter comprises a rectifier 16 located on the side of the adapter through which the electrical current is passed. The non-rectified side of the adapter is neutral and does not conduct electrical current.

The adapter shown in FIG. 3A is non-polarized. In other words, the two adapter plug 12 blades and the two adapter outlet 14 holes are identical in size to each other, although only one side includes the rectifier 16 through which the live electrical current is passed; the other side is directly connected.

Figure 3B:
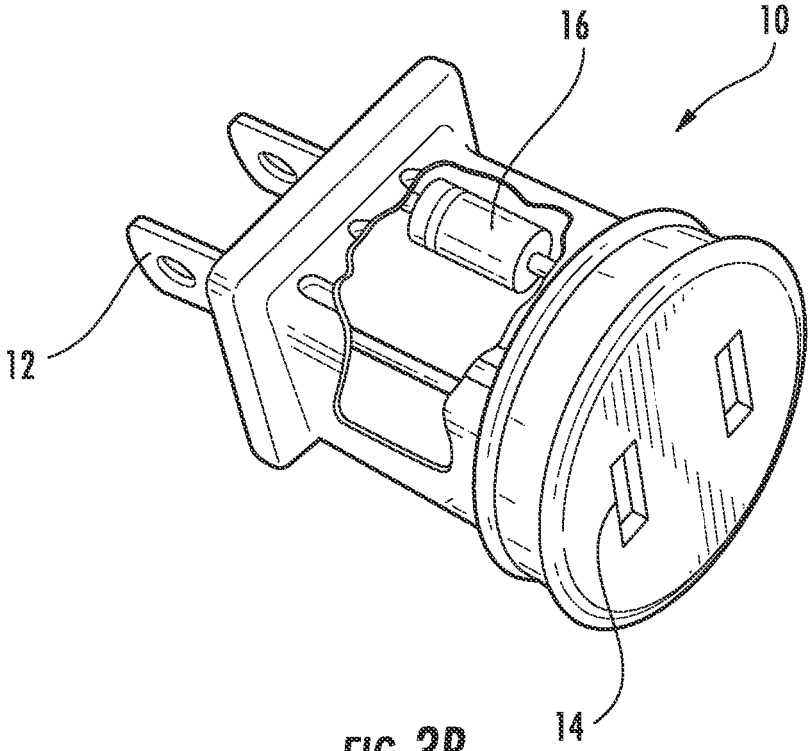
FIGS. 3B and 3D are depictions of a cutaway view of an adapter according to some embodiments of the present disclosure.

FIG. 3B is a representation of the schematically depicted adapter of FIG. 3A with a portion of the outer covering cut away to show the inside of the adapter 10. There is an electrically conductive material connecting each adapter plug blade to each adapter outlet hole. As depicted in FIG. 3B, the electrically conductive material is a metal wire, but other materials could be successfully used and would still fall within the scope of the present invention. For example, in some embodiments, the electrically conductive material is a metal blade rather than a metal wire. One of ordinary skill in the art understands that many approaches may be used to conduct the live current from the power source into the adapter plug and from there to the adapter outlet, and such approaches are not limiting to the scope of the invention.

As seen in FIG. 3B, on a first side of the adapter 10, the electrically conductive material connecting the adapter plug 12 blade to the adapter outlet 14 hole is interrupted by a rectifier 16. As the electrical current passes through the rectifier, it is converted from a full sine wave to a half sine wave. On a second side of the adapter, the electrically conductive material passes uninterrupted from the adapter plug blade to the adapter outlet hole.

Figure 3C:
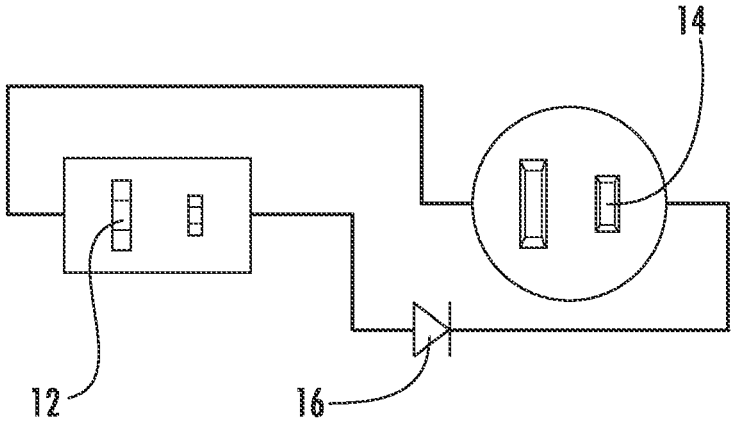

FIG. 3C is a schematic depiction of an adapter 10 according to at least some embodiments of the present invention, wherein the adapter includes a rectifier 16. FIG. 3C shows an adapter comprising an adapter plug 12 electrically connected to an adapter outlet 14. The adapter shown in FIG. 3C is polarized. In other words, the one of the two adapter plug 12 blades is larger than the other and one of the two adapter outlet 14 holes is larger than the other.

Figure 3D:
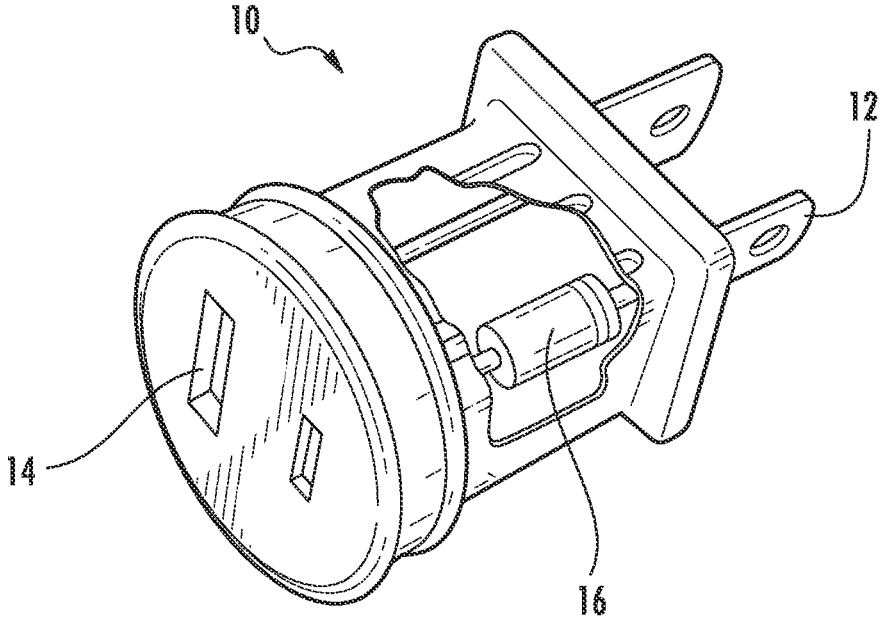

FIG. 3D is a representation of the schematically depicted adapter of FIG. 3C, with a portion of the outer covering cut away to show the inside of the adapter 10. As seen in FIG. 3D, on one side of the adapter, the electrically conductive material connecting the adapter plug 12 blade to the adapter outlet 14 hole is interrupted by a rectifier 16. As the electrical signal passes through the rectifier 16, it is converted from a full sine wave to a half sine wave. In the polarized embodiment of the adapter as depicted in FIG. 3D, the rectifier 16 is located between the smaller adapter plug 12 blade and the smaller adapter outlet 14 hole (referred to as the "hot" side in U.S. standards).

Referring to FIGS. 4A-4D, the adapter 10 of the present disclosure accepts the plug 26 of the light string 20 in one of two possible orientations. FIG. 4A is a schematic view depicting a light string system according to an embodiment of the present disclosure wherein the light string plug 26 is in a first orientation, thereby connecting the rectifier 16 in a forward bias direction relative to a first LED chip 36*a* and thus providing a half-period sine AC waveform to light the LEDs in parallel in a first light bulb color according to the first LED chip 36*a*.

FIG. 4B is a depiction of the light string system represented in the schematic of FIG. 4A. FIG. 4B shows the plug 26 of the light string plugged into the adapter 10 in a first orientation (position represented by knob 42 on plug 26, wherein in the present example the knob 42 is on the upper side of plug 26). When the plug 26 of the light string is plugged into the adapter 10 in a first orientation, the sine wave is half rectified and the current flows through the first LEDs (connected in parallel with 36*a*), thus lighting the bulbs with a first color as dictated by the first LEDs.

FIG. 4C is a schematic view depicting a light string system according to an embodiment of the present disclosure wherein the light string plug 26 is plugged into the adapter 10 in a second orientation, connecting the rectifier 16 in a forward bias direction relative to the second LED chip 36*b* and thus providing a half-period sine AC waveform to light the LEDs in reverse parallel in a second light bulb color according to the second LED chip 36*b*.

FIG. 4D is a depiction of the light string system represented in the schematic of FIG. 4C. FIG. 4D shows the plug 26 of the light string plugged into the adapter 10 in a second orientation, so that knob 42 of plug 26 is located on the lower side of the plug 26. When the plug 26 of the light string is plugged into the adapter 10 in a second orientation, with knob 42 located on the lower side of the plug 26, the sine wave is half rectified and the current flows through the second LEDs (connected in parallel with 36*b*), thus lighting the bulbs with the second color as dictated by the second LEDs.

In contrast to the bulb lighting outcomes depicted in FIGS. 4A-4D, a third outcome is achieved if the light string described and depicted in FIG. 4 is plugged directly into a power source, rather than into the adapter. If the plug 26 of the light string is plugged directly into a power source, the full sine wave will pass through the light string, lighting both the first 36*a* and second 36*b* LEDs simultaneously. Thus, for example, if the first LEDs emit white light, and the second LEDs emit red light, then plugging the plug of the light string directly into a power source would give the light from the bulbs a pink or pastel appearance.

In at least some embodiments, when the plug of the light string 26 is plugged into the adapter 10 in a first orientation, the first LED chip 36*a* is forward biased relative to the second LED chip 36*b*, lighting the LEDs connected in parallel according to the first LED chip 36*a*. In at least some embodiments, when the plug of the light string 7 is plugged into the adapter 4 in a second orientation, the second LED chip 36*b* is forward biased relative to the first LED chip 36*a*, lighting the LEDs connected in reverse parallel according to the second LED chip 36*b*. Thus, the changing of the color of the light emitted from the light bulbs is achieved by unplugging the plug of the light string 26 from the adapter 10, turning the plug of the light string 26 by 180 degrees, and plugging the plug 26 back into the adapter 10, with each blade of the plug 26 placed in the outlet hole opposite the hole it was in originally.

In at least some embodiments, the system further comprises at least one current limiting resistor 15 that is serially connected to the light string for limiting current.

In a preferred embodiment of the present disclosure, the at least two LED chips are within a single bulb or housing. In such embodiments, the two LED chips can be adopted, connected in parallel, connected in reverse parallel, and integrated into a same housing. In this particular scenario, the connection thereof is very convenient and the connection wire can be saved, allowing for this string of lights to be manufactured identically to existing LED strings. In one embodiment, the two LED chips comprised in the single housing have two kinds of colors that can be emitted when the two LEDs emit light individually and respectively. Moreover, another one or more colors of light may be achieved by adjusting the overlap time or the sequence of the two LEDs which emit light at the same time. For example, in one embodiment, connecting the light string of the present disclosure directly into a power source such as a standard wall socket, and bypassing the adapter, will result in both LEDs emitting light at the same time, thereby providing additional colors and hues (e.g., pastel colors resulting from the mixing of white light generated from one LED chip and a colored light, such as blue, from the second LED chip). Alternatively, the timing of the lighting of both LEDs may be altered to adjust the color as desired. As used herein, the terms "housing" or "bulb" refer to any transparent or translucent material that allows at least some light to pass through, such as glass or plastic.

In other embodiments, each bulb may have more LEDs connected, preferably in even number sets. For example, a bulb may comprise 4, 6, 8 or 10 LED chips, where half of the LED chips are connected in parallel and the other half of the LED chips are connected in reverse parallel. For example, for a bulb comprising 4 LED chips, 2 LED chips may be connected in parallel, and the other two chips may be connected in reverse parallel. In certain embodiments, each LED chip will emit a different color. In other embodiments, all of the LED chips connected in parallel will emit one color, e.g., blue, red, green, yellow, white, etc., while the other LED chips connected in reverse parallel will emit a second color that is different from those connected in parallel. In a preferred embodiment, each bulb comprises 2 LED chips, one that is connected in parallel and the other that is connected in reverse parallel. More preferably, each chip is manufactured to emit a color different from the other. It is also within the scope of the present disclosure that any combination of colors may be used. Furthermore, the number of bulbs on each light string can be adjusted accordingly, and can be readily determined by those skilled in the art. In certain embodiments, a light string will comprise between 10 and 200 bulbs (inclusive) electrically connected in series. In other embodiment, the light string will comprise between 10 and 150 bulbs (inclusive) electrically connected in series. In yet other embodiments, the light string will comprise between 10 and 100 bulbs (inclusive) electrically connected in series.

In other embodiments, a plurality of light strings may be serially linked together. In one embodiment, at least two light strings are serially linked together. In another embodiment, at least three light strings are serially linked together. In yet another embodiment, at least four light strings are serially linked together. In still another embodiment, at least five light strings are serially linked together. The number of light strings serially linked together does not change the function of the adapter. A light string plug at the end of the light strings serially linked together must be plugged into an adapter outlet. Once that occurs, all of the lights in all the strings will perform according to the orientation in which the light string plug at the end of the light strings serially linked together is plugged into the adapter outlet. In some embodiments, if a user wishes to change the color of the lights from one set of LEDs to the other, the user simply must unplug the light string plug at the end of the light strings serially linked together from the adapter outlet, turn the light string plug over a half turn (180 degrees) and plug the light string plug back into the adapter outlet. If a user wishes to activate both of the LEDs in all strings, the user can unplug the light string plug at the end of the lights strings serially linked together from the adapter outlet and plug it directly into the power source. Thus, the light string at the end of the series will control the passage of waveforms to all strings in series.

In a preferred embodiment, the system further comprises a current limiting resistor 15 that is serially connected to the light string for limiting current. The system may also comprise a plurality of light strings connected serially together. Moreover, the system may also comprise an adapter having at least a second outlet, whereby each outlet comprises a plurality of light strings connected thereto.

According to another aspect, the present disclosure provides a method of changing colors on a light string according to the present disclosure by connecting the adapter comprising a rectifier to a power means and connecting the plug of the light string into the adapter outlet in a first orientation or a second orientation, wherein when the plug of the light string is in the first orientation, the rectifier allows passage of a positive half-rectified wave that is passed through the light string lighting half of the LEDs connected in parallel in a first color. For example, the lighting of the half of LEDs connected in parallel may result in the generation of white light.

The methods of the present disclosure further provide optionally plugging the plug of the light string into the adapter outlet in a second orientation, wherein the rectifier allows passage of a half-rectified wave through the light string thus lighting half of the LEDs connected in reverse parallel in a second color. For example, the lighting of the half of LEDs connected in reverse parallel may result in the generation of multicolored lights (green, blue, red, and yellow).

It is to be understood that the above is merely a description of preferred embodiments of the disclosure and that various changes, alterations, and variations may be made without departing from the true spirit and scope of the invention as set forth in the appended claims. The several embodiments and variations described above can be combined with each other were suitable. The particular color schemes for the holidays described herein are merely examples and may vary. It is not necessary that the plurality of wires along the decorative light string be intertwined or bound; they could be provided in a 2-dimensional matrix or 3-dimensional structure. Also, the lights in each set need not be interleaved with lights of another set or sets. Few if any of the terms or phrases in the specification and claims has been given any special or particular meaning different from the plain language meaning, and therefore the specification is not to be used to define the terms in an unduly narrow sense.

We claim:

1. An adapter comprising:

a first end comprising an adapter plug;

a second end comprising an adapter outlet; and a rectifier placed between one side of the adapter plug and the corresponding side of the adapter outlet, wherein the other side of the adapter is non-rectified, the adapter is configured to receive a plug of a light string, wherein the plug of the light string is plugged into the adapter at orientations to adjust current flow.

2. A method of using the adapter of claim 1 to half-rectify the electrical current passing through a wired system, said method comprising:

connecting the adapter to a power means;

connecting a plug of a wired system into the adapter outlet in a first orientation, wherein when the plug of the wired system is in the first orientation, the rectifier allows passage of a half-rectified wave that is passed through the wired system for at least a first set of parallel wired elements; and connecting the plug of the wired system into the adapter outlet in a second orientation, wherein when the plug of the wired system is in the second orientation, the rectifier allows passage of a half-rectified wave that is passed through the wired system for at least a second set of parallel wired elements.

3. The adapter of claim 1, wherein the adapter is polarized.

4. The adapter of claim 1, wherein the adapter is non-polarized.

5. The adapter of claim 1, wherein the adapter comprises a second outlet.

6. A decorative light system comprising:

at least one light string comprising a first end comprising a plug, a second end comprising a receptacle to receive a plug electrically connected to the plug of the first end , and a plurality of light bulbs dispersed between the first end and the second end, each light bulb arranged electrically in series, the light bulbs comprising at least two LED chips, wherein at least one LED chip is connected in parallel and at least one LED chip is connected in reverse parallel; and an adapter comprising a first end comprising an adapter plug, a second end comprising an adapter outlet, and a rectifier placed between one side of the adapter plug and the corresponding side of the adapter outlet, wherein the other side of the adapter is non-rectified and wherein the plug of the light string is plugged into the adapter outlet and the adapter plug is connected to a power source; and wherein if the plug of the light string is plugged into the adapter outlet in a first orientation, the first LED chip is forward biased relative to the second LED chip, lighting the LEDs connected in parallel according to the first LED chip and wherein if the plug of the light string is plugged into the adapter outlet in a second orientation, the second LED chip is forward biased relative to the first LED chip, lighting the LEDs connected in parallel according to the second LED chip, wherein the plug of the light string is plugged into the adapter at orientations to adjust current flow.

7. The decorative light system according to claim 6, further comprising a plurality of light strings electrically connected in series.

8. The decorative light system according to claim 6, further comprising at least one current limiting resistor serially connected to the light string.

9. The decorative light system according to claim 6, wherein the bulb comprises at least a first LED in a first color and at least a second LED in a second color.

10. A method of changing the color of light emitted from bulbs on a light string system comprising a plug, the light bulbs comprising at least two LED chips, wherein at least one LED chip is connected in parallel and at least one LED chip is connected in reverse parallel and an adapter comprising a rectifier placed between one side of an adapter plug and a corresponding side of the adapter outlet, said method comprising:

connecting the adapter to a power means;

connecting the plug of the light string into the adapter outlet, wherein when the plug of the light string is in a first orientation, the rectifier is connected allowing passage of a positive half-rectified wave that is passed through the light string lighting half of the LEDs connected in parallel in a first color; and reversing the plug of the light string to the second orientation, wherein the rectifier is connected allowing passage of a half-rectified wave that is passed through the light string thereby lighting half of the LEDs connected in reverse parallel in a second color, wherein the plug of the light string is plugged into the adapter at orientations to adjust current flow.

11. The method of claim 10, wherein the light string is directly connected to the power means.

12. The method of claim 11, wherein the first color is white and the second color is red such the combined color is that of a pink or pastel appearance.

13. The method of claim 10, further comprising changing the color of light by unplugging the plug of the light string from the adapter, turning the plug of the light string by 180 degrees, plugging the plug back into the adapter, with each blade of the plug placed in an outlet hole opposite the outlet hole that the blade of the plug was in originally.

14. The method of claim 10, further comprising adjusting an overlap time of the LEDs.

* * * * *